US005130219A

United States Patent [19]

Mori et al.

[11] Patent Number: 5,130,219

[45] Date of Patent: Jul. 14, 1992

[54] COLOR TONER AND PROCESS FOR FIXING THE SAME

[75] Inventors: Hiromi Mori; Reiko Morimoto, both of Yokohama; Tatsuya Nakamura, Tokyo, all of Japan

[73] Assignee: Canon Kabushiki Kaisha, Tokyo, Japan

[21] Appl. No.: 508,706

[22] Filed: Apr. 13, 1990

[30] Foreign Application Priority Data

Apr. 17, 1989 [JP] Japan ..... 1-095157

[51] Int. Cl.[5] ..... G03G 9/09; G03G 9/097

[52] U.S. Cl. ..... 430/106; 430/110; 430/111

[58] Field of Search ..... 430/106, 110, 111

[56] References Cited

U.S. PATENT DOCUMENTS

| | | | |
|---|---|---|---|
| 4,514,487 | 4/1985 | Kosuya et al. | 430/137 |
| 4,565,763 | 1/1986 | Uchiyama et al. | 430/109 |
| 4,581,312 | 4/1986 | Nakahara et al. | 430/109 X |
| 4,626,488 | 12/1986 | Inoue | 430/109 |
| 4,803,143 | 2/1989 | Ostertag et al. | 430/111 X |
| 4,913,991 | 4/1990 | Chiba et al. | 430/111 X |
| 4,939,060 | 7/1990 | Tomiyama et al. | 430/109 X |
| 4,966,829 | 10/1990 | Yasuda et al. | 430/109 |

FOREIGN PATENT DOCUMENTS

| | | | |
|---|---|---|---|
| 158340 | 12/1981 | Japan | 430/111 |
| 60-57855 | 4/1985 | Japan . | |
| 159856 | 8/1985 | Japan | 430/111 |
| 62-54277 | 3/1987 | Japan . | |
| 33558 | 2/1989 | Japan | 430/111 |

*Primary Examiner*—Roland Martin

*Attorney, Agent, or Firm*—Fitzpatrick, Cella, Harper & Scinto

[57] ABSTRACT

A color toner for developing electrostatic images including a resin component and a colorant, said resin component comprising a THF (tetrahydrofuran)-soluble and containing substantially no toluene-insoluble; wherein the THF-soluble provides a molecular weight distribution in the GPC (gel permeation chromatography) thereof such that there are a peak (Mp1) in the molecular weight range of 500 to 2,000, and a peak (Mp2) in the molecular weight range of 10,000 to 100,000; the weight-average molecular weight (Mw) is 10,000 to 80,000, the number-average molecular weight (Mn) is 1,500 to 8,000, and the rate of $Mw/Mn \geqq 3$.

27 Claims, 2 Drawing Sheets

COLOR TONER AND PROCESS FOR FIXING THE SAME

FIELD OF THE INVENTION AND RELATED ART

The present invention relates to a color toner excellent in fixability and anti-offset property. The present invention also relates to a process for fixing a color toner which is capable of providing fixed images of color toner excellent in surface gloss characteristic and color tone.

Hitherto, fixing devices to be used for a heat fixing method generally used a fixing system wherein a toner-supporting member such as transfer material (or transfer-receiving material) carrying an unfixed toner image on its surface is sandwiched between and conveyed by a heating roller maintained at a predetermined temperature, and a pressing roller which has an elastic (or elastomeric) layer and is caused to contact the heating roller under pressure.

In this type of device, there sometimes occurs a so-called "offset phenomenon" such that the unfixed toner disposed on a toner-supporting member is attached to the heating roller side for heating the toner so as to fuse and fix the toner onto the toner-supporting member, and the toner attached to the heating roller is then transferred to the next toner-supporting member. Particularly, in an apparatus for forming full-color images, plural species of color toners are fixed at a relatively high temperature so that they are subjected to color mixing in their nearly melted states, unlike the case of a mono-color toner fixing step wherein a toner is simply softened to be fixed onto a toner-supporting member under pressure. Accordingly, the offset phenomenon is more liable to occur in such an apparatus.

In order to prevent the offset phenomenon, a method of incorporating a crosslinked resin in a toner has generally been used. When such a method is used, an anti-offset property is imparted to the toner, but the toner deteriorates in its heat-fusion property. In the reproduction of a medium-tone color, the presence of the crosslinked resin component is not preferred for a color toner wherein plural species of color toners are required to be disposed on a toner-supporting member in a mixing state and are required to be melted on the toner-supporting member. Accordingly, in the heat roller fixing method for color toner, so-called "high-temperature offset" is generally prevented by applying a releasing substance such as silicone oil onto the heating roller side.

Alternatively, British Patent No. 1,442,835 discloses a method wherein a releasing substance such as polyethylene wax and polypropylene wax is added to a toner so that the anti-offset property thereof to a heating roller may be enhanced. However, when a sufficient amount of the polyethylene wax or polypropylene wax is added to a color toner so that the releasing property to a heating roller may satisfactorily be imparted to the color toner, a sufficient transparency is not obtained in the case of a fixed image which has been fixed onto a transparent toner-supporting member.

U.S. Pat. No. 3,578,797 proposes another method of solving the offset problem, wherein a toner image is heated and melted up to its melting point by means of a heating member, the toner image is then cooled to a state providing a relatively high viscosity, and a toner supporting member having thereon the toner image is peeled from a heating web in a state where the adhesiveness of the toner is reduced, thereby fixing the toner image without causing the offset. U.S. Pat. No. 3,578,797 also teaches that the toner image is heated without causing the toner image and a toner-supporting member to contact the heating member under pressure, and the toner-supporting member is not positively heated, whereby the toner may be melted by using a small quantity of energy.

However, when the toner-supporting member is caused to contact the heating member without pressure, the heat conduction efficiency is decreased and it takes a relatively long time to heat the toner to be melted. Particularly, in the case of a full-color toner image, the toners of the respective colors are required to be subjected to color mixing in their nearly melted states. Accordingly, the fixing method described in U.S. Pat. No. 3,578,797 requires further improvement when it is intended to be used for the formation of a full-color toner image.

Japanese Patent Publication (JP-B, KOKOKU) No. 29825/1976 proposes an addition of pressure contact means to the fixing system described in U.S. Pat. No. 3,578,797 so that the heat conduction efficiency may be improved and the toner may be sufficient be heated and fused in a short period of time. This method enables sufficient heat-fusion of the toner due to the contact under pressure, and is preferred in color mixing for color toner image. However, since the toner image is pressed at the time of heat-fusion thereof, the adhesion between the heating member and the toner becomes strong, and the releasability therebetween poses a problem even after the cooling thereof. In the above-mentioned Japanese Patent Publication No. 29825/1976, a fluorine-containing resin such as polytetrafluoroethylene (trade name: Teflon) having a low surface energy is used as the surface portion of the heating member, and the adhesion between the toner and the heating member is intended to be decreased, whereby the releasability therebetween is enhanced.

It is conceivable that a material having a releasability is incorporated in a color toner in order to satisfactorily fix a color toner onto a toner-supporting member and to suppress the offset phenomenon by using the fixing device or fixing method as described in U.S. Pat. No. 3,578,797 or Japanese Patent Publication No. 29825/1976. However, when a sufficient amount of polyethylene wax or polypropylene wax is added to a color toner so that the color toner is satisfactorily imparted with releasability to a heating member, a sufficient transparency is not obtained in the resultant fixed color toner image which has been fixed onto a transparent toner-supporting member. Accordingly, a color toner which is suitable for a heat-fixing method and is excellent in releasability is desired.

SUMMARY OF THE INVENTION

An object of the present invention is to provide a color toner which is suitable for a heat-fixing method, is excellent in anti-offset property, and is capable of providing a clear color toner image having a high saturation.

Another object of the present invention is to provide a color toner which is excellent in anti-offset property and is capable of providing a color toner fixed image having a high transparency on a transparent toner-supporting member.

A further object of the present invention is to provide a color toner which is capable of providing a color toner fixed image excellent in anti-bending property.

A further object of the present invention is to provide a fixing method for a color toner which is capable of providing a color toner fixed image excellent in surface gloss property and color tone.

A further object of the present invention is to provide a fixing method for a color toner which is capable of effecting color mixing of plural color toners.

According to the present invention, there is provided a color toner for developing electrostatic images, comprising a resin component and a colorant, said resin component comprising a THF (tetrahydrofuran)-soluble and containing substantially no toluene-insoluble; the THF-soluble providing a molecular weight distribution in the GPC (gel permeation chromatography) thereof such that there are a peak (Mp1) in the molecular weight range of 500 to 2,000, and a peak (Mp2) in the molecular weight range of 10,000 to 100,000; the weight-average molecular weight (Mw) is 10,000 to 80,000, the number-average molecular weight (Mn) is 1,500 to 8,000, and the rate of $Mw/Mn \geqq 3$.

The present invention also provides a process for fixing a color toner image, comprising:

heating a color toner image disposed on a toner-supporting member by the medium of a film, thereby to fix the color toner image to the toner-supporting member, wherein the color toner image comprises a color toner or a mixture thereof, and the color toner comprises a resin component and a colorant; the resin component comprising a THF (tetrahydrofuran)-soluble and containing substantially no toluene-insoluble; the THF-soluble providing a molecular weight distribution in the GPC (gel permeation chromatography) thereof such that there are a peak (Mp1) in the molecular weight range of 500 to 2,000, and a peak (Mp2) in the molecular weight range of 10,000 to 100,000; the weight-average molecular weight (Mw) is 10,000 to 80,000, the number-average molecular weight (Mn) is 1,500 to 8,000, and the rate of $Mw/Mn \geqq 3$.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1:
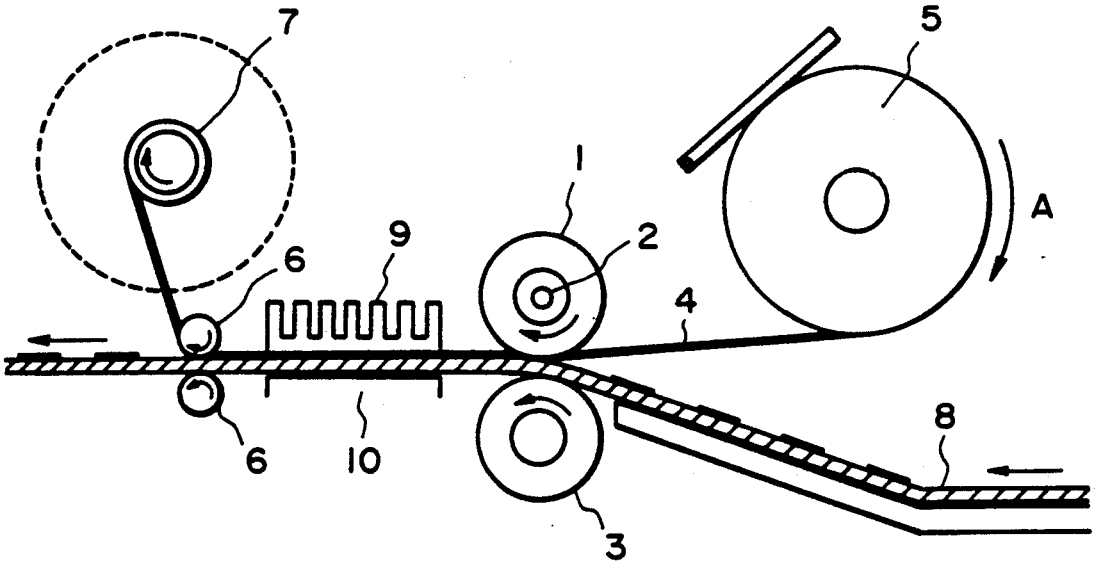
FIG. 1 is a schematic sectional view showing an embodiment of the heat-fixing device for fixing the color toner according to the present invention.
Figure 2:
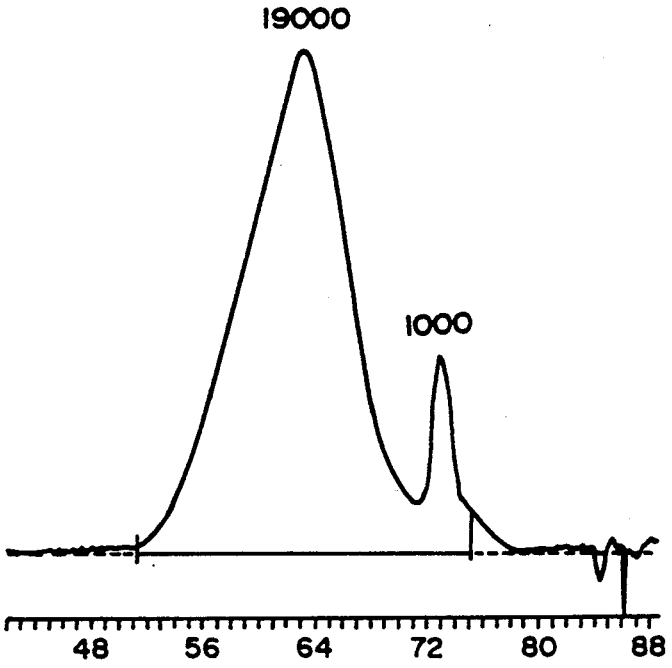
FIG. 2 is a GPC (gel permeation chromatography) chart of the resin component of the color toner obtained in Example 1 appearing hereinafter.

As a result of our investigation, we have obtained the following knowledge relating to a color toner to be used for heat fixing. Based on such knowledge, we have reached the present invention.

Thus, in a case of a color toner obtained through the conventional pulverization process, when a releasing substance is added to such a toner, the releasing substance is present not only in the interior of the toner particles but also on the surfaces thereof. In a case where a toner obtained through the pulverization process (hereinafter, referred to as "pulverization toner") is applied to a heat fixing method, it is necessary to add to the toner an appropriate amount of a low-molecular weight substance providing a low melt viscosity, in order to impart sufficient releasability to fixed images with respect to a heat-resistant sheet (e.g., a sheet 4 in FIG. 1 or a film 15 in FIG. 3 described hereinafter) or heating roller of a fixing device. However, in the case of the pulverization toner, since the above-mentioned low-molecular weight substance is also present on the toner particle surfaces, the anti-blocking property of the toner may pose a problem. Accordingly, in the pulverization toner, it is difficult to satisfy both the releasability and anti-blocking property of the toner by using the above-mentioned low-molecular weight substance. On the other hand, when a high-molecular weight substance causing no problem in the anti-blocking property is added to a toner, it is necessary to add a large amount of the high-molecular weight substance to a color toner, in order to impart sufficient anti-offset property to the color toner. In such a case, however, since a large amount of a high-melting point (or high-softening point) substance is added to the color toner, the energy for fixing the color toner is inevitably increased, i.e., the fixing temperature is elevated and/or the fixing speed is reduced. Further, the transparency of a color toner fixed image formed on a transparent carrier is lowered. In order to attain a color toner suitable for heat fixing, it is necessary for the color toner to contain a low-molecular weight component excellent in releasability so as to enhance the anti-offset property, and to have satisfactory anti-blocking property, and transparency after fixing.

As a result of our study based on the above knowledge, we have found that the above-mentioned problems may be solved by using for a color toner a resin component which contains substantially no toluene-insoluble, and comprises a tetrahydrofuran (THF)-soluble providing a molecular weight distribution in the chromatogram of GPC (gel permeation chromatography) thereof such that there are a peak (Mp1) in the molecular weight range of 500 to 2,000 and a peak (Mp2) in the molecular weight range of 10,000 to 100,000.

The resin component providing a peak in the molecular weight range of 500 to 2,000 (preferably 800 to 1,500) may preferably comprise a non-polar substance and may preferably have a releasability. For example, the resin component providing a peak in the molecular weight range of 500 to 2,000 may preferably comprise a paraffin wax, and the paraffin wax may preferably be contained or enclosed in the interior of color toner particles. Such color toner particles enclosing a paraffin wax in the interior thereof may be prepared by a suspension polymerization method as described hereinafter.

When the melting point of the paraffin wax is lower than an environmental temperature, the paraffin wax can be liquefied at the environmental temperature and can ooze out to the surface layer portion of the toner particles even when the paraffin wax is included in the interior of the toner particles. Such oozing can sometimes cause blocking of the toner. Accordingly, the melting point of the paraffin wax may preferably be 55° C. or higher, more preferably 65°-100° C., particularly preferably 70°-80° C. The paraffin wax may preferably be contained in the toner in an amount of 5-50 wt. %, more preferably 9–25 wt. %, based on the weight of the resin component of the toner. If the wax content is below 5 wt. %, sufficient releasability is less liable to be imparted to the toner. If the wax content exceeds 50 wt. %, the paraffin wax is less liable to be sufficiently enclosed in the interior of the toner particles, whereby it can cause blocking of the toner particles.

The melting point of a paraffin wax may be measured according to the following method.

Measurement of melting point

The melting point of a paraffin wax may be measured according to a differential scanning calorimetry (DSC). A differential scanning calorimeter DSC-7 (available from Perkin Elmer Corp.) may be used for such a purpose.

A sample to be measured is accurately weighed of 5–20 mg, preferably about 10 mg. The same is placed on an aluminum pan with an empty aluminum pan as the reference and is subjected to DSC in the temperature range of 30° C. to 200° C. at a temperature raising rate of 10° C./min in the environment of normal temperature and normal humidity. In such a temperature raising process, a heat-absorption peak as a main peak is observed in the temperature range of 30°–160° C. In the present invention, the melting point of the paraffin wax may be defined as the temperature at which the above-mentioned main heat-absorption peak is observed.

The resin component providing a peak in the molecular weight range of 10,000 to 100,000 functions as a binder resin of the color toner.

The color toner according to the present invention may provide a molecular weight distribution in the chromatogram of GPC (gel permeation chromatography) thereof such that there is a peak in the molecular weight range of 500 to 2,000 and a peak in the molecular weight range of 10,000 to 100,000.

The resin component of the color toner may preferably have a Mw (weight-average molecular weight) of 10,000 to 80,000 (more preferably 10,000 to 40,000); an Mn (number-average molecular weight) of 1,500 to 8,000 (more preferably 2,000 to 6,000); and/or a ratio (Mw/Mn) of 3 or larger (more preferably 4.0 to 10.0).

In the present invention, the molecular weight of the resin component of the color toner may be measured in the following manner.

(1) Preparation of samples:

(i) Standard samples:

Commercially available standard polystyrene samples as described below may be used. In the following description, Tosoh K. K. is abbreviated as "T", and Waters Co., U.S.A. is abbreviated as "W".

| <Molecular weight> | <Maker> |
|---|---|
| $8.42 \times 10^6$ | T |
| $2.7 \times 10^6$ | W |
| $1.2 \times 10^6$ | W |
| $7.75 \times 10^5$ | T |
| $4.7 \times 10^5$ | W |
| $2.0 \times 10^5$ | W |
| $3.5 \times 10^4$ | W |
| $1.5 \times 10^4$ | W |
| $1.02 \times 10^4$ | T |
| $3.6 \times 10^3$ | W |
| $2.35 \times 10^3$ | W |
| $5.0 \times 10^2$ | T |

The above-mentioned 12 species of standard polystyrene samples are classified into three groups as follows corresponding to their molecular weights:

First group:

$8.42\times10^6$, $7.75\times10^5$, $3.5\times10^4$, $3.6\times10^3$

Second group:

$2.7\times10^6$, $4.7\times10^5$, $1.5\times10^4$, $2.35\times10^3$

Third group:

$1.2\times10^6$, $2.0\times10^5$, $1.02\times10^4$, $5.0\times10^2$

About 3 mg (i.e., a spoonful of sample measured by a micro-spatula) of each of the four standard samples constituting one group of the First to Third groups as described above is charged into a 30 ml-sample bottle, whereby about 12 mg of four species of samples are charged in one sample bottle in total. 15 ml of THF (tetrahydrofuran) is further charged into each bottle and the resultant mixture is left standing for 4 hours at room temperature. During this standing period of time, the sample bottle is vigorously shaken for 1 min at intervals of 30 min. Thereafter, the mixture is subjected to filtration by means of a membrane filter comprising regenerated cellulose (pore size: 0.45 micron, e.g., a product mfd. by Toyo Roshi K. K.), and the thus obtained three species of filtrates are used as standard sample solutions.

(ii) Sample for measurement:

60 mg of a sample (e.g., color toner) is charged into a sample bottle, 15 ml of THF (tetrahydrofuran) is further charged into the sample bottle, and the resultant mixture is left standing at room temperature for 24 hours. During the initial three hours of the 24 hours, the sample bottle is shaken by hands for 1 min. at intervals of 30 min. Thereafter, ultrasonic vibrations (output=200 W, frequency=40 KHz) are applied to the sample bottle for 15 min, thereby to effect sufficient extraction. The insoluble matter in the resultant mixture is subjected to sedimentation by centrifugal separation at 5,000 rpm for 20 min, and the resultant supernatant liquid is subjected to filtration by means of a membrane filter comprising regenerated cellulose (pore size: 0.45 micron, e.g., a product mfd. by Toyo Roshi K. K.), and the thus obtained filtrate is used as a sample solution for measurement.

(2) GPC measurement:

The measurement device used herein may be "150C ALC/GPC", mfd. by Waters Co., U.S.A.. The measurement is effected under the following conditions:

(i) Solvent: THF (e.g., guaranteed reagent of THF mfd. by Kishida Kagaku)

(ii) Column: A column obtained by connecting four species of commercially available columns of Shodex A-802, A-803, A-804 and A-805 (mfd. by Showa Denko), in series.

(iii) Temperature: 28° C.

(iv) Flow rate: 1.0 ml/min (v) Injection amount: 0.5 ml (vi) Detector: RI (refractive index)

(3) GPC data processing method:

(i) Calibration curve

Each of the above-mentioned standard samples is subjected to GPC measurement to obtain a chromatogram, and the retention time at which each peak occurs on the resultant chromatogram is read. When the chromatogram corresponding to one standard sample has plural peaks, the retention time corresponding to the main peak is defined as the retention time for the standard sample. Thereafter, a calibration curve is obtained by plotting the relationship between the molecular weights of the standard samples and the above-mentioned retention times thereof.

(ii) Measurement of sample

The sample for measurement is subjected to GPC measurement to obtain a chromatogram, and the retention time at which a peak occurs on the resultant chromatogram is read. The molecular weight of the sample may be determined by using the thus obtained retention time and the above-mentioned calibration curve.

The resin component of the color toner according to the present invention contains substantially no toluene-insoluble (i.e., gel content). The toluene insoluble is determined by the value measured as described below.

1 g of a sample is weighed accurately, placed in a cylindrical filter paper (e.g. No. 86R, produced by Toyo Roshi K. K.), and immersed in 1 liter of toluene under refluxing to extract a toluene-soluble for 24 hours while the toluene is dripped to the sample by means of a Soxhlet extractor. After the extraction, the filter paper is dried and weighed accurately (W2g). The toluene-insoluble is defined from the following formula:

$$\text{Toluene-insoluble (gel content)} = [(W_2 - W_0)/(W_1 - W_0)] \times 100\ (\%)$$

$W_0$: The weight (g) of the cylindrical filter paper.

$W_1$: The weight (g) of (sample+cylindrical filter paper) before the extraction.

$W_2$: The weight (g) of the cylindrical filter paper after the extraction and drying.

In the present invention, the toluene-insoluble may preferably be 1 % or below, more preferably 0.5 % or below, particularly preferably 0.1 or below.

In a case where the sample contains another component (i.e., non-resinous component such as pigment) other than the resin component, the weights of $W_1'$ and $W_2'$ may be used instead of the above-mentioned weights $W_1$ and $W_2$, respectively, thereby to obtain the toluene-insoluble. The weight $W_1'$ is obtained by subtracting the weight of the non-resinous component from $W_1$ The weight $W_2'$ is obtained by subtracting the weight of the non-resinous component from $W_2$.

The color toner according to the present invention may be well fixed onto a toner-supporting member even by using a conventional heat-roller fixing device. Particularly, since the color toner according to the present invention contains a resinous component (e.g., a paraffin wax) providing a clear maximum value in the molecular weight range of 500 to 2,000, the color toner has an excellent anti-offset property with respect to a heat roller (particularly, a heat roller coated with a fluorine-containing resin) and also has an excellent fixability at a low temperature.

In addition, the color toner according to the present invention may preferably be used in a heat fixing method wherein the toner is heated by the medium of a film so that the toner is fixed onto a toner-supporting member.

Hereinbelow, with reference to FIG. 1, there is described an embodiment of the heat fixing method wherein the color toner according to the present invention may be well fixed.

Referring to FIG. 1, a heating roller 1 contains a heater 2 in the inside thereof. The heating roller 1 comprises a metal tube and an elastic (or elastomeric) layer disposed thereon, which comprises an elastic material such as fluorine-containing rubber and silicone rubber. The surface temperature of the heating roller 1 may be maintained at a predetermined temperature (e.g., 140°-200° C.).

A pressure roller 3 comprises a metal core and en elastic (or elastomeric) layer disposed thereon, which comprises an elastic material such as fluorine-containing rubber and silicone rubber. Heating roller 1 and pressure roller 3 are driven by a driving device (not shown) so as to provide the same peripheral speeds.

The heating roller 1 and the pressure roller 3 are caused to contact each other under pressure by the medium of a heat-resistant sheet (or film) 4. The heat-resistant sheet 4 wound about a feed shaft 5 rotating in the arrow A direction is passed between the heating roller 1 and the pressure roller 3, is passed through a separation roller 6 having a large curvature, and is wound up about a wind-up shaft 7.

The heat-resistant sheet may comprise a heat-resistant resin such as polyimide, polyester and polyamide. For example, an approximately 9 micron-thick polyimide film (preferably having a thickness of 1-100 microns, more preferably 1-50 microns) having a surface coated with a fluorine-containing resin, or an approximately 9 micron-thick polyester film imparted with heat-resistant by a treatment may serve as the heat-resistant shell. The moving speed of the heat-resistant sheet 4 may be the same as the peripheral speed of the heating roller 1, or the pressure roller 3.

In the fixing device shown in FIG. 1, a color toner image disposed on a toner-supporting member (or transfer material) such as plain paper and OHP (overhead projector) film is heated by means of the heating roller 1 and the pressure roller 3 by the medium of the heat-resistant sheet 4, to be melted or softened. Thereafter, the toner image is passed between a radiation plate 9 and a guide plate 10 also functioning as a radiation plate, before it reaches the separation roller 6, so that the toner image is forcibly cooled to be solidified. Thereafter, the heat-resistant sheet 4 is passed through the separation roller 6 having a large curvature and then separated from the toner-supporting member 8.

According to the heat fixing method using the fixing device as shown in FIG. 1, since the heat-resistant sheet and the fixed toner image are separated from each other after the fixed toner image is cooled to be solidified, a high-temperature offset phenomenon does not occur. Accordingly, in such a heat fixing method, it is sufficient to pay attention to anti-offset property and releasability at room temperature without consideration of the high-temperature offset phenomenon, while in the prior art, the molecular weight of a resin component has been designed in consideration of releasability, anti-blocking property and anti-offset property at a high temperature with respect to the toner to be used for the conventional fixing device using heat and pressure rollers.

Figure 3:
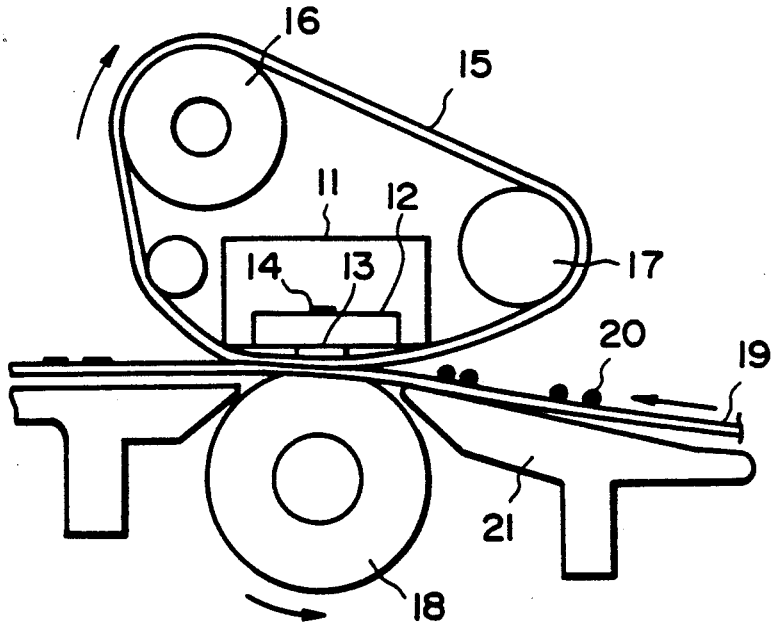
FIG. 3 is a schematic sectional view showing another heat-fixing device capable of well fixing the color toner according to the present invention.

FIG. 3 shows another heat fixing method capable of well fixing the color toner according to the present invention.

Referring to FIG. 3, a film 15 disposed between a heating member 11 and a pressing member 18 may preferably comprise a heat-resistant sheet having a thickness of 1-100 microns (more preferably 1-50 microns). The heat-resistant sheet may preferably comprise a polymer sheet having a high heat resistance, such as polyester, PET (polyethylene terephthalate), PFA (tetrafluoroethylene-perfluoroalkylvinyl ether copolymer), PTFE (polytetrafluoroethylene), polyimide and polyamide; a metal sheet such as aluminum sheet, and a laminate sheet comprising a metal sheet and a polymer sheet.

These heat-resistant sheets may more preferably have a releasing layer and/or a low-resistance layer.

Referring to FIG. 3, a linear heating member 11 having a small heat capacity is fixed to and supported by a fixing device. For example, the heating member 11 may comprise an alumina substrate 12 having a thickness of 1.0 mm, a width of 10 mm and a longitudinal length of 240 mm; and 1.0 mm-wide coating of a resistance material 13 disposed thereon. A current is passed through the heating member 11 between the both ends in the longitudinal direction thereof. In such current conduction, a DC voltage of 100 V in a pulse-like waveform having a period of 20 msec is applied to the heating member 11, while the pulse duration of the pulse is changed corresponding to a desired temperature controlled by a temperature detection element 14, and energy emission quantity. The pulse duration may preferably be 0.5 to 5 msec.

In contact with the heating member 11 wherein the energy and temperature are controlled, the fixing film 15 is moved in the direction shown by the arrow in FIG. 3. The fixing film may for example be an endless film comprising a 20 micron-thick heat-resistant film, and a 10 micron-thick coating disposed thereon containing an electroconductive material. The heat-resistant film used herein may for example comprise polyimide, polyether-imide, PES (polyester) or PFA, having a coating of a fluorine-containing resin such as PTFE on at least the image-contacting surface thereof. In general, the fixing film may preferably have a total thickness of below 100 microns, more preferably, of below 40 microns. The fixing film 15 is driven in the direction shown by the arrow in FIG. 3 by driving force and tension based on a driving roller 16 and a roller 17, so as not to be wrinkled.

In FIG. 3, reference numeral 18 denotes a pressure roller having a rubbery elastic layer with good releasability, such as silicone rubber, and presses the heating member 11 by the medium of the fixing film 15 under a total pressure of 4–20 kg. The roller 18 is rotated while contacting the film 15 under pressure. An unfixed toner 20 disposed on the toner-supporting member 19 is guided by an inlet guide 21 to a fixing position and is fixed onto the toner-supporting member 19 to provide a fixed toner image under heating as described above.

The color toner according to the present invention may for example be prepared in the following manner.

A colorant and an optional additive such as wax (e.g., a paraffin wax), and polymerization initiator are added to a polymerizable monomer and are uniformly dissolved or dispersed by means of a dispersing machine such as ultrasonic dispersing machine and homogenizer, thereby to prepare a monomer composition. The thus obtained monomer composition is then dispersed in an aqueous phase (i.e., continuous phase) containing a suspension stabilizer under stirring by means of an ordinary stirrer or a strong shear-force stirrer such as homomixer and homogenizer. Preferably, the speed and time for stirring may be adjusted so that the droplets of the monomer composition have a desired toner particle size (e.g., 30 microns or below).

After that, stirring is effected to such an extent that the dispersion state is substantially maintained as such while preventing the sedimentation. The polymerization temperature may be set to 40° C. or above, preferably 50°–90° C. It is preferred to change the polymerization temperature in the course of the polymerization, in order to regulate the molecular weight distribution of the resultant resin component. After the completion of the reaction, the resultant toner particles are washed, recovered by filtration, and dried, thereby to obtain a polymerization toner. In the suspension polymerization, 300–3000 wt. parts of water may ordinarily be used as a dispersion medium with respect to 100 wt. parts of the polymerizable monomer.

In the suspension polymerization process, a wax having substantially no hydroxyl, carboxyl, or ester group may be enclosed in the interior of the resultant toner particles.

The polymerizable monomer applicable to the present invention may be a vinyl-type monomer. Specific examples of the vinyl monomer include: styrene and its derivatives such as styrene, o-methylstyrene, m-methylstyrene, p-methylstyrene, p-methoxystyrene, and p-ethylstyrene; methacrylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethyhexyl acrylate, stearyl acrylate, 2-chloroethyl acrylate, and phenyl acrylate; derivatives of acrylic acid and methacrylic acids such as acrylonitrile, methacrylonitrile, and acrylamide. These monomers may be used either singly or in a mixture of two or more species. Among these, it is preferred to use styrene or its derivative alone or in combination with another monomer in view of the developing characteristics and durability of the resultant toner.

Specific examples of the polymerization initiator usable in the present invention may include: azo- or diazo-type polymerization initiators such as 2,2'-azobis-(2,4-dimethylvaleronitrile), 2,2'-azobisisobutylonitrile (AIBN), 1,1'-azobis(cyclohexane-dimethylvaleronitrile; and peroxide-type polymerization initiators such as benzoyl peroxide, methyl ethyl ketone peroxide, isopropyl peroxycarbonate, cumene hydroperoxide, 2,4-dichlorobenzoyl peroxide and lauroyl peroxide.

The amount of use of the polymerization initiator may generally be in the range of about 0.5–5 wt. % based on the weight of the polymerizable monomer.

In the preparation of the color toner according to the present invention through suspension polymerization, it is preferred to use a mixture of at least two species of polymerization initiators, in view of regulation of molecular weight distribution of the resultant resin component. It is further preferred to use a mixture of a polymerization initiator providing a half-life of 100 to 500 min, and a polymerization initiator providing a half-life of 1,000 to 5,000 min, at the reaction temperature in the initial stage of the polymerization.

In the present invention, it is further preferred to polymerize the monomer while a polymer having a polar group or a copolymer having a polar group is added to the monomer at the time of polymerization.

In the present invention, it is preferred that a polymerizable monomer composition containing a polar material (such as the polymer or copolymer having a polar group or cyclized rubber) thus added is suspended in an aqueous phase containing a dispersant dispersed therein which has a reverse polarity to that of the polar material, and is subjected to polymerization.

The cationic polymer (inclusive of copolymer), anionic polymer (inclusive of copolymer) or anionic cyclized rubber thus contained in the polymerizable monomer composition exerts an electrostatic force at the surface of toner-forming particles with the anionic or cationic dispersant having the reverse polarity dispersed in the aqueous phase, so that the dispersant covers the surface of the particles to prevent coalescence of the particles with each other and to stabilize the dispersion. In addition, as the added polar material gathers at the surface layer of the particles, a sort of shell is formed to provide the particles with a pseudo-capsule structure. While the polar material of a relatively large molecular weight thus gathered at the particle surfaces provides the polymerization toner particles of the present invention with excellent anti-blocking characteristic, developing characteristic, and abrasion resistance, the polymerization may be conducted in the interior thereof to provide a relatively low molecular weight which may contribute to an improvement in fixability of the toner. As a result, the resultant toner according to the present invention may satisfy both of fixability and anti-blocking characteristics which can sometimes be antagonistic to each other.

Specific examples of the above-mentioned polar material and the dispersant having the reverse polarity are described below.

(a) Cationic polymers (or copolymers): polymers of nitrogen-containing monomers such as dimethylaminoethyl methacrylate and diethylaminoethyl acrylate; copolymers of styrene and such a nitrogen-containing monomer; and compolymers of an unsaturated carboxylic acid ester and such a nitrogen-containing monomer.

(b) Anionic polymers (or copolymers): polymers or copolymers of anionic monomers inclusive of nitrile monomers such as acrylonitrile, halogen-containing monomers such as vinyl chloride, unsaturated carboxylic acid such as acrylic acid, unsaturated dibasic acids, and unsaturated dibasic acid anhydrides; and nitro-type monomers.

(c) Anionic dispersant: colloidal silica such as Aerosil #200, #300 and #380 (mfd. by Nihon Aerosil K. K.).

(d) Cationic dispersant: calcium phosphate fine powder, aluminum hydroxide fine powder, aluminum oxide fine powder, and hydrophilic positively chargeable silica fine powder such as aminoalkyl-modified colloidal silica.

The above-mentioned cyclized rubber may be used instead of the anionic polymer or copolymer.

The amount of addition of the dispersant may preferably be 0.2–20 wt. parts, particularly 0.3–15 wt. parts, with respect to 100 wt. parts of the polymerizable monomer.

The colorant to be contained in the color toner according to the present invention may for example comprise a dye or pigment. Specific examples thereof may include: phthalocyanine pigments, azo pigments, quinacridone pigments, xanthene pigments, carbon black, etc. The colorant may preferably be used in an amount of 0.5–40 wt. parts, more preferably 1–25 wt. parts, per 100 wt. parts of the resin component.

The charge control agent which may be added to the color toner as desired may be selected from those generally known in the art. Specific examples thereof may include: nigrosine, azine dyes containing an alkyl group having 2–16 carbon atoms, metal complex salts of monoazo dyes, and metal complex salts of salicylic acid, dialkylsalicylic acid, etc.

In the case of the nigrosine or azine-type dye, it is preferred to use a very small amount of such an agent (e.g., 0.3 wt. % or below, more preferably 0.05–0.2 wt. %, based on the weight of the resin component) so that the agent does not substantially impair the color tone of a color toner such as cyan toner, magenta toner and yellow toner.

The color toner according to the present invention may preferably have an agglomeration degree of 40 % or below, more preferably 1–30 %, even after left standing at 50° C. for 48 hours. The agglomeration after the standing at 50° C. for 48 hours may be considered as a barometer of the anti-blocking property of the color toner. Color toner particles having a poor anti-blocking property provide a high agglomeration degree after left standing at 50° C. for 48 hours, since they agglomerate form agglomerates or aggregates.

The agglomeration degree of a color toner (or color toner composition containing an additive such as hydrophobic colloidal silica mixed therewith) may be measured in the following manner.

Measurement of agglomeration degree

A sample (i.e., a toner or toner composition containing an additive such as colloidal silica) is left standing under the conditions of 23° C. and 60 %RH for about 12 hours, and is subjected to measurement under the conditions of 23° C. and 60 %RH.

On the other hand, 5 g of the sample is charged into a 100 ml-polyethylene container and left standing at 50° C. for 48 hours, and the agglomeration degree of the sample after the standing is measured.

As an instrument for measurement, Powder Tester (available from Hosokawa Micron K. K.) is used.

For measurement, a 60-mesh sieve, a 100 mesh-sieve and a 200-mesh sieve are superposed in this order from the above and set on a vibration table. An accurately measured sample in an amount of 5 g is placed on the 60-mesh sieve, and the vibration table is subjected to vibration for about 15 seconds under the conditions of an input voltage to the vibration table of 21.7 V, and a vibration amplitude in the range of 60–90 microns (a rheostat scale: about 2.5). The weights of the sample remaining on the respective sieves are measured to calculate the agglomeration degree from the following equation:

Agglomeration degree (%)=[(sample weight on 60-mesh sieve/5 g)×100]+[(sample weight on 100-mesh sieve/5 g)×100×3/5]+[(sample weight on 200-mesh sieve/5 g)×100×1/5].

In the present invention, a fluidity improver may be mixed with or externally added to the color tone particles (external addition). Specific examples of the fluidity improver may include: colloidal silica, hydrophobic colloidal silica, fatty acid metal salt, teflon fine powder, etc. Further, for the purpose of extension, a filler such as calcium carbonate and silica fine powder may be added to the toner in an amount of 0.5–20 wt. %.

The color toner according to the present invention is applicable to the known dry system methods for developing electrostatic images. For example, in an embodiment wherein the color toner according to the present invention is a non-magnetic toner, it is applicable to developing methods including the two-component developing methods such as the cascade method, the magnetic brush method, the microtoning method and the two-component AC bias developing method; the powder cloud method and the fur brush method; the non-magnetic one-component developing method wherein the toner is carried on a toner-carrying member by electrostatic force to be conveyed to a developing position and subjected to development thereat; and the electric field curtain method wherein the toner is conveyed by an electric field curtain to a developing position and subjected to development thereat.

Hereinbelow, the present invention will be described based on Examples.

EXAMPLE 1

| | |
|---|---|
| Styrene | 170 wt. parts |
| 2-Ethylhexyl acrylate | 30 wt. parts |
| Chromium complex of di-tert-butylsalicylic acid | 3 wt. parts |
| 2,2'-Azobis(2,4-dimethylvaleronitrile) (polymerization initiator, trade name: V-65, mfd. by Wako Junyaku, half-life at 60° C. = 240 min.) | 10 wt. parts |
| Dimethyl 2,2'-azobisisobutyrate (polymerization initiator, trade name: V-601, mfd. by Wako Junyaku, half-life at 60° C. = 2000 min.) | 1 wt. part |
| Paraffin wax (melting point = 70° C., mfd. by Nihon Seiro) | 30 wt. parts |
| Colorant (C.I. Pigment Yellow 17) | 4 wt. parts |

The above-mentioned materials were dissolved or dispersed while being maintained at 60° C., thereby to prepare a monomer composition.

Separately, 10 wt. parts of colloidal silica (inorganic dispersion stabilizer or dispersing agent) treated with aminoalkyl silane coupling agent was added to 1200 wt. parts of ion-exchanged water, and the resultant mixture was adjusted to a pH value of 6 by using hydrochloric acid, thereby to prepare an aqueous dispersion medium. Into the thus prepared aqueous dispersion medium, the above-mentioned monomer composition was charged and stirred under an atmosphere of nitrogen by means of T. K. Homomixer (mfd. by Tokushu Kika Kogyo) at 8,000 rpm for 60 min., thereby to granulate the monomer composition. Thereafter, the monomer composition was subjected to polymerization at 60° C. for 7 hours and then at 80° C. for 4 hours, while being stirred by means of a paddle stirrer.

After the polymerization was completed, the reaction product was cooled to room temperature, sodium hydroxide was added thereto to dissolve the dispersing agent (colloidal silica), and then the reaction product was subjected to filtration, washing with water and drying, thereby to obtain a yellow toner.

Some physical properties of the thus obtained yellow toner are shown in Table 1 appearing hereinafter.

EXAMPLE 2

Suspension polymerization was conducted in the same manner as in Example 1 except for using 10 wt. parts of C.I. Pigment Blue 15:3 as the colorant, thereby to obtain a cyan toner.

Some physical properties of the thus obtained cyan toner are shown in Table 1 appearing hereinafter.

EXAMPLE 3

Suspension polymerization was conducted in the same manner as in Example 1 except for using 1.5 wt. parts of C.I. Solvent Red 49 and 2 wt. parts of C.I. Solvent Red 52 as the colorant, thereby to obtain a magenta toner.

Some physical properties of the thus obtained magenta toner are shown in Table 1 appearing hereinafter.

COMPARATIVE EXAMPLE 1

Yellow, cyan and magenta toners were prepared in the same manner as in Example 1, 2 and 3, respectively, except for using no paraffin wax.

Some physical properties of the thus obtained respective toners are shown in Table 1 appearing hereinafter.

COMPARATIVE EXAMPLE 2

Yellow, cyan and magenta toners were prepared in the same manner as in Example 1, 2 and 3, respectively, except that 2 wt. parts of a crosslinking agent:

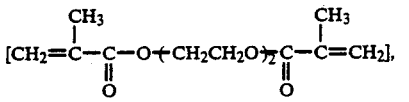

was further added to the monomer composition and the resultant monomer composition was subjected to suspension polymerization.

Some physical properties of the thus obtained respective toners are shown in Table 1 appearing hereinafter.

COMPARATIVE EXAMPLE 3

| | |
|---|---|
| Styrene-2-ethylhexylacrylate copolymer (copolymerization weight ratio = 17:3, Mw (weight-average molecular weight) = 17,000) | 200 wt. parts |
| Chromium complex of di-tert-butylsalicylic acid | 3 wt. parts |
| Low-molecular weight polypropylene (Mw = 6,300) | 30 wt. parts |
| Colorant (C.I. Pigment Yellow 17) | 4 wt. parts |

The above-mentioned materials were melt-kneaded, at 150° C. for about 20 min, cooled, pulverized and classified, thereby to prepare a yellow toner having a volume-average particle size of 11.0 microns through a pulverization process.

Some physical properties of the thus obtained yellow toner are shown in Table 1 appearing hereinafter.

COMPARATIVE EXAMPLE 4

A cyan toner having a volume-average particle size of 11.2 microns was prepared through a pulverization process in the same manner as in Comparative Example 3 except for using C.I. Pigment Blue 15:3 as the colorant.

Some physical properties of the thus obtained cyan toner are shown in Table 1 appearing hereinafter.

COMPARATIVE EXAMPLE 5

A magenta toner having a volume-average particle size of 11.0 microns was prepared through a pulverization process in the same manner as in Comparative Example 3 except for using 1.5 wt. parts of C.I. Solvent Red 49 and 2 wt. parts of C.I. Solvent Red 52 as the colorant.

Some physical properties of the thus obtained magenta toner are shown in Table 1 appearing hereinafter.

COMPARATIVE EXAMPLE 6

A yellow toner was prepared through a pulverization process in the same manner as in Comparative Example 3 except for using 30 wt. parts of a paraffin wax (melting point=70° C.) instead of the low-molecular weight polypropylene.

The thus obtained toner showed an agglomeration degree of 26 % at 23° C., 60 %RH, and showed an agglomeration degree of 98 % after left standing at 50° C., 30 %RH for 48 hours, whereby the toner was poor in anti-blocking property.

TABLE 1

| | Mp 1 | Mp 2 | Mw | Mn | Mw/Mn | Toluene-insoluble (%) | Volume-average particle size (μm) |
|---|---|---|---|---|---|---|---|
| Example 1 (yellow toner) | 1000 | 19000 | 29000 | 6100 | 4.8 | 0 | 10.8 |
| Example 2 (cyan toner) | 1000 | 20000 | 29000 | 6200 | 4.7 | 0 | 11.0 |
| Example 3 (magenta toner) | 1000 | 18000 | 28500 | 6000 | 4.8 | 0 | 10.7 |
| Comp. Example 1 (yellow toner) | — | 19000 | 30500 | 8500 | 3.6 | 0 | 10.7 |
| (cyan toner) | — | 20000 | 31200 | 8600 | 3.6 | 0 | 10.7 |
| (magenta toner) | — | 19000 | 30000 | 8400 | 3.0 | 0 | 10.5 |
| Comp. Example 2 (yellow toner) | 1000 | 20000 | 34200 | 8600 | 4.0 | 29 | 10.7 |
| (cyan toner) | 1000 | 21000 | 35000 | 8700 | 4.0 | 31 | 10.9 |
| (magenta toner) | 1000 | 20000 | 34000 | 8600 | 4.0 | 27 | 10.8 |
| Comp. Example 3 (yellow toner) | — | 11000 | 15000 | 5400 | 2.8 | 0 | 11.0 |
| Comp. Example 4 (cyan toner) | — | 11000 | 15000 | 5400 | 2.8 | 0 | 11.2 |
| Comp. Example 5 (magenta toner) | — | 11000 | 15000 | 5400 | 2.8 | 0 | 11.0 |

In the above Table 1, $M_1$ denotes the molecular weight corresponding to the lower-molecular weight side peak of a GPC chart, and $M_2$ denotes the molecular weight corresponding to the higher-molecular weight side peak thereof. Mw denotes a weight-average molecular weight, and Mn denotes a number-average molecular weight.

EXAMPLE 4 AND COMPARATIVE EXAMPLE 7

0.5 wt. part of negatively chargeable hydrophobic colloidal silica was mixed with 100 wt. parts of each of color toners obtained in Examples 1 to 3 and Comparative Examples 1 to 5, thereby to prepare 12 species of color toners comprising toner particles having the hydrophobic colloidal silica on their surfaces.

8 wt. parts of each of the thus prepared 12 species of color toners containing the hydrophobic colloidal silica was mixed with 92 wt. parts of ferrite carrier (average particle size=about 50 microns) coated with styrene-acrylic resin, thereby to prepare 12 species of two-component developers having respective colors.

Each of the thus prepared two-component developers were subjected to image formation tests by means of a copying machine for color image formation (trade name: CLC-1, mfd. by Canon K. K.) by using plain paper and OHP (overhead projector) films as an image-supporting member thereby to form unfixed mono-color and full-color toner images, respectively. Each of the unfixed toner images was then fixed onto the image-supporting member 8 by means of a fixing device as shown in FIG. 1 wherein a 20 micron-thick polyimide film coated with fluorine-containing resin was used as the film 4. In this fixing operation, the fixing temperature (surface temperature of the heating roller 1) was 160° C., the pressure per unit area between the heating roller 1 and pressure roller 3 was 5 kg/cm$^2$, and the fixing speed was 50 mm/sec.

The results are shown in the following Table 2.

TABLE 2

| | Anti-offset property | Saturation | Surface gloss (%) | Fixability | Agglomeration degree 23° C. | Agglomeration degree after 50° C., 48 hrs. | Color-mixing property | Transmissive property of fixed toner image on OHP film* |
|---|---|---|---|---|---|---|---|---|
| Example 1 (yellow toner) | Excellent | 73.6 | 12 | Excellent | 7.7 | 7.7 | Excellent | Excellent (58% at 560 nm) |
| Example 2 (cyan toner) | Excellent | 45.6 | 10 | Excellent | 6.5 | 6.6 | Excellent | Excellent (57% at 460 nm) |
| Example 3 (magenta toner) | Excellent | 61.2 | 14 | Excellent | 8.2 | 8.5 | Excellent | Excellent (57% at 660 nm) |
| Comp. Example 1 | | | | | | | | |
| (yellow toner) | Bad | — | — | — | 7.0 | 7.1 | — | — |
| (cyan toner) | Bad | — | — | — | 6.2 | 6.2 | — | — |
| (magenta toner) | Bad | — | — | — | 7.8 | 7.8 | — | — |
| Comp. Example 2 | | | | | | | | |
| (yellow toner) | Good | 65.2 | 2.7 | Good | 7.2 | 7.3 | Bad | Bad (25% at 560 nm) |
| (cyan toner) | Good | 43.1 | 1.7 | Good | 6.2 | 6.3 | Bad | Bad (20% at 460 nm) |
| (magenta toner) | Good | 57.3 | 2.9 | Good | 7.6 | 7.6 | Bad | Bad (26% at 660 nm) |
| Comp. Example 3 | Not bad | 72.8 | 8.6 | Not bad | 7.9 | 17.2 | Not bad | Not bad |

TABLE 2-continued

| | Anti-offset property | Saturation | Surface gloss (%) | Fixability | Agglomeration degree 23° C. | Agglomeration degree after 50° C., 48 hrs. | Color-mixing property | Transmissive property of fixed toner image on OHP film* |
|---|---|---|---|---|---|---|---|---|
| (yellow toner) | | | | | | | | (46% at 560 nm) |
| Comp. Example 4 (cyan toner) | Not bad | 44.0 | 8.2 | Not bad | 8.2 | 16.2 | Not bad | Not bad (44% at 460 nm) |
| Comp. Example 5 (magenta toner) | Not bad | 59.7 | 9.0 | Not bad | 7.8 | 20.0 | Not bad | Not bad (48% at 660 nm) |

*The light-transmissive properties or transparencies of fixed toner images are represented by spectral transmittances at respective wavelengths.

Respective color toners of Comparative Example 1 had poor anti-offset property and had no fixing wherein an offset phenomenon (cold offset and hot offset) did not occur. Accordingly, it was impossible to evaluate fixed image.

EXAMPLE 5

| | |
|---|---|
| Styrene | 170 wt. parts |
| 2-Ethylhexyl acrylate | 30 wt. parts |
| Chromium complex of di-tert-butylsalicylic acid | 3 wt. parts |
| Dimethyl 2,2'-azobisisobutyrate (polymerization initiator, trade name: V-601, mfd. by Wako Junyaku, | 10 wt. parts |
| Paraffin wax (melting point = 70° C., mfd. by Nihon Seiro) | 50 wt. parts |
| Colorant (C.I. Pigment Yellow 17) | 4 wt. parts |

The above-mentioned materials were dissolved or dispersed while being maintained at 60° C., thereby to prepare a monomer composition.

Separately, 10 wt. parts of colloidal silica (inorganic dispersion stabilizer or dispersing agent) treated with aminoalkyl silane coupling agent was added to 1200 wt. parts of ion-exchanged water, and the resultant mixture was adjusted to a pH value of 6 by using hydrochloric acid, thereby to prepare an aqueous dispersion medium. Into the thus prepared aqueous dispersion medium, the above-mentioned monomer composition was charged and stirred under an atmosphere of nitrogen by means of T.K. Homomixer (mfd. by Tokushu Kika Kogyo) at 8,000 rpm for 60 min., thereby to granulate the monomer composition. Thereafter, the monomer composition was subjected to polymerization at 60° C. for 6 hours and then at 80° C. for 5 hours, while being stirred by means of a paddle stirrer.

After the polymerization was completed, the reaction product was cooled to room temperature, sodium hydroxide was added thereto to dissolve the dispersing agent, and then the reaction product was subjected to filtration, washing with water and drying, thereby to obtain a yellow toner.

Some physical properties of the thus obtained yellow toner are shown in Table 3 appearing hereinafter.

EXAMPLE 6

Suspension polymerization was conducted in the same manner as in Example 5 except for using 45 wt. parts of the paraffin wax used in Example 5, and 10 wt. parts of C.I. Pigment Blue 15:3 as the colorant, thereby to obtain a cyan toner.

Some physical properties of the thus obtained cyan toner are shown in Table 3 appearing hereinafter.

EXAMPLE 7

Suspension polymerization was conducted in the same manner as in Example 5 except for using 45 wt. parts of the paraffin wax, and 1.5 wt. parts of C.I. Solvent Red 49 and 2 wt. parts of C.I. Solvent Red 52 as the colorant, thereby to obtain a magenta toner.

Some physical properties of the thus obtained magenta toner are shown in Table 3 appearing hereinafter.

EXAMPLE 8

A black toner was prepared in the same manner as in Example 5 except for using 20 wt. parts of carbon black (trade name: Regal 400R, mfd. by Cabot Co.) treated with an aluminum coupling agent (trade name: AL-M, mfd. by Ajinomoto K. K.) as the colorant.

Some physical properties of the thus obtained black toner are shown in Table 3 appearing hereinafter.

EXAMPLES 9-16

Respective color toners were prepared in the same manner as in Examples 5, 6, 7 and 8, respectively, except for using the paraffin wax in an amount as described in the following Table 4.

Some physical properties of the thus obtained respective toners are shown in Table 3 appearing hereinafter.

COMPARATIVE EXAMPLES 8-11

Respective color toners were prepared in the same manner as in Example 5, 6, 7 and 8, respectively, except for using no paraffin wax.

Some physical properties of the thus obtained respective color toners are shown in Table 4 appearing hereinafter.

TABLE 3

| | Color tone of color toner | Molecular weight characteristics Mp 1 (× $10^3$) | Mp 2 (× $10^3$) | Mw (× $10^3$) | Mn (× $10^3$) | Mw/Mn | Toluene-insoluble (%) | Volume-average particle size (μm) | Triboelectric charge amount (μc/g) |
|---|---|---|---|---|---|---|---|---|---|
| Ex. 5 | Yellow | 0.9 | 14.6 | 31.6 | 3.2 | 9.9 | 0 | 11.2 | −20.5 |
| Ex. 6 | Cyan | 1.0 | 16.5 | 22.3 | 2.4 | 9.3 | 0 | 11.5 | −21.2 |
| Ex. 7 | Magenta | 1.0 | 21.2 | 26.2 | 2.6 | 10 | 0 | 11.9 | −22.0 |
| Ex. 8 | Black | 0.9 | 19.6 | 25.5 | 4.2 | 6.1 | 0 | 11.0 | −22.5 |

TABLE 3-continued

| | Color tone of color toner | Molecular weight characteristics Mp 1 (× $10^3$) | Mp 2 (× $10^3$) | Mw (× $10^3$) | Mn (× $10^3$) | Mw/Mn | Toluene-insoluble (%) | Volume-average particle size (μm) | Triboelectric charge amount (μc/g) |
|---|---|---|---|---|---|---|---|---|---|
| Ex. 9 | Yellow | 1.0 | 17.8 | 31.7 | 3.7 | 8.6 | 0 | 12.0 | −22.1 |
| Ex. 10 | Cyan | 1.0 | 14.6 | 30.0 | 3.3 | 9.1 | 0 | 11.5 | −21.6 |
| Ex. 11 | Magenta | 0.9 | 17.3 | 31.7 | 5.0 | 6.3 | 0 | 11.6 | −20.3 |
| Ex. 12 | Black | 1.0 | 17.2 | 25.5 | 4.8 | 5.3 | 0 | 11.9 | −21.9 |
| Ex. 13 | Yellow | 0.9 | 17.3 | 31.7 | 5.0 | 6.3 | 0 | 11.5 | −21.3 |
| Ex. 14 | Cyan | 1.0 | 13.2 | 23.9 | 5.7 | 4.2 | 0 | 11.6 | −20.6 |
| Ex. 15 | Magenta | 1.0 | 20.1 | 33.6 | 3.8 | 5.7 | 0 | 11.8 | −22.5 |
| Ex. 16 | Black | 0.9 | 18.3 | 29.8 | 3.6 | 8.3 | 0 | 11.9 | −22.0 |
| Comp. Ex. 8 | Yellow | — | 22.1 | 28.3 | 4.4 | 6.4 | 0 | 12.1 | −20.0 |
| Comp. Ex. 9 | Cyan | — | 17.8 | 32.5 | 5.2 | 6.3 | 0 | 12.0 | −20.5 |
| Comp. Ex. 10 | Magenta | — | 11.5 | 23.9 | 4.3 | 5.6 | 0 | 11.9 | −22.3 |
| Comp. Ex. 11 | Black | — | 14.0 | 28.5 | 5.6 | 5.1 | 0 | 11.5 | −22.5 |

TABLE 4

| Example | Toner | Amount of paraffin wax (wt. parts) |
|---|---|---|
| Ex. 9 | Yellow | 40 |
| Ex. 10 | Cyan | 40 |
| Ex. 11 | Magenta | 40 |
| Ex. 12 | Black | 40 |
| Ex. 13 | Yellow | 35 |
| Ex. 14 | Cyan | 35 |
| Ex. 15 | Magenta | 40 |
| Ex. 16 | Black | 40 |

supporting member thereby to form unfixed monocolor and full-color toner images, respectively. Each of the unfixed toner images was then fixed onto the image-supporting member 8 by means of a fixing device as shown in FIG. 1 wherein a 30 micron-thick polyester film was used as the film 4. In this fixing operation, the fixing temperature was 160° C., the pressure per unit area between the heating roller 1 and pressure roller 3 was 5 kg/cm$^2$, and the fixing speed was 50 mm/sec.

The results are shown in the following Table 5.

TABLE 5

| Toner | Anti-offset property | Saturation | Surface gloss | Fixability | Agglomeration degree 23° C. | after 50° C., 48 hrs. | Color-mixing property | Light-transmissive property of fixed toner image on OHP film |
|---|---|---|---|---|---|---|---|---|
| Ex. 9 (yellow) | Excellent | 73.8 | 14 | Excellent | 11.2 | 11.4 | Excellent | Excellent (56% at 560 nm) |
| Ex. 10 (cyan) | Excellent | 45.8 | 12 | Excellent | 10.5 | 10.5 | Excellent | Excellent (56% at 460 nm) |
| Ex. 11 (magenta) | Excellent | 61.4 | 16 | Excellent | 13.4 | 13.7 | Excellent | Excellent (55% at 660 nm) |
| Ex. 12 (black) | Excellent | (1.8) | 18 | Excellent | 13.7 | 14.0 | — | — |
| Comp. Ex. 7 (yellow) | Bad | — | — | — | 8.4 | 8.6 | — | — |
| Comp. Ex. 8 (cyan) | Bad | — | — | — | 8.2 | 8.2 | — | — |
| Comp. Ex. 9 (magenta) | Bad | — | — | — | 9.4 | 9.2 | — | — |
| Comp. Ex. 10 (black) | Bad | — | — | — | 8.5 | 8.7 | — | — |

EXAMPLE 17 AND COMPARATIVE EXAMPLE 12

0.5 wt. part of negatively chargeable hydrophobic colloidal silica was mixed with 100 wt. parts of each of color toners obtained in Examples 9 to and Comparative Examples 7 to 10, thereby to prepare eight species of color toners comprising toner particles having the hydrophobic colloidal silica on their surface.

8 wt. parts of each of the thus prepared eight process of color toners containing the hydrophobic colloidal silica was mixed with 92 wt. parts of ferrite carrier coated with styrene-acrylic resin, thereby to prepare eight species of two-component developers having respective colors.

Each of the thus prepared two-component developers were subjected to image formation tests by means of a copying machine for color image formation (trade name: CLC-1, mfd. by Canon K. K.) by using plain paper and OHP (overhead projector) films as an image- Toners of Comparative Examples 7–10 had poor anti-offset property and had no fixing condition providing a non-offset region. Accordingly, it was impossible to evaluate fixed images of these toners.

EXAMPLE 18

Image formation tests and heat-fixing tests were conducted in the same manner as in Example 17 except that a 20 micron-thick polyimide film was used as the fixing film 4 and respective color toners obtained in Examples 5 to 8 were used. Good results similar to those obtained in Example 17 were obtained.

EXAMPLE 19

Image formation tests and heat-fixing tests were conducted in the same manner as in Example 17 except that a 20 micron-thick polyimide film was used as the fixing film 4, respective color toners obtained in Examples 5 to 8 were used, and the fixing temperature was 150° C.

Good results similar to those obtained in Example 17 were obtained.

EXAMPLE 20

Mono-color and full-color toner images obtained through the image formation tests in Example 4 were fixed under heating by means of a heat-fixing device as shown in FIG. 3, whereby good fixed images were obtained.

In the heat fixing device shown in FIG. 3, the surface temperature $T_1$ of a heating member 11 was measured by means of a temperature detection element 14, the electric power consumption in the resistance material constituting the heating element was 150 W, total pressure between the heating member 11 and a pressure roller 18 was 5 kg, nip width between the pressure roller 18 and a film 15 was 3 mm, and the rotating speed of the fixing film 15 was 30 mm/sec. In this instance, there was used, as a heat-resistant sheet, a 20 micron-thick polyimide film having thereon a releasing layer which comprised PTFE (polytetrafluoroethylene) and an electroconductive substance (carbon black) dispersed therein so that the releasing layer could contact a toner-supporting member 19 carrying thereon a color toner 20.

In this instance, the period of time required for elevating the surface temperature T1 of the heating member to 150° C. was about 3 sec. Further, the surface temperature $T_2$ of the surface the film 15 contacting the resistance material 13 was 145° C., and the temperature $T_3$ of the film at the time of peeling of the film 15 from the toner-supporting member 19 was 144° C.

EXAMPLE 21

Mono-color and full-color toner images obtained through the image formation tests in Example 4 were fixed by using a heat roller fixing device comprising a roller coated with a fluorine-containing resin as a heating roller and a silicone rubber roller as a pressure roller. In this fixing operation, the temperature of the heating roller was set to 140° C. and the fixing speed was 150 mm/sec.

As a result, the color toners were well fixed onto the toner-supporting member, and no offset phenomenon was observed.

What is claimed is:

1. A color toner for developing electrostatic images comprising a resin composition and a colorant, said resin composition comprising a paraffin wax and a resin produced by suspension polymerization of a polymerizable monomer comprising a vinyl monomer or a mixture of vinyl monomers in combination with paraffin wax and said colorant, said paraffin wax comprising 5–50% based on the weight of said resin composition; said resin composition comprising a THF (tetrahydrofuran)-soluble component and substantially no toluene-insoluble component; said THF-soluble component providing a molecular weight distribution in the GPC (gel permeation chromatography) thereof such that (i) there are a peak (Mp1) in the molecular weight range of 500 to 2,000 and a peak (Mp2) in the molecular weight range of 10,000 to 100,000; (ii) the weight-average molecular weight (Mw) being 10,000 to 80,000; (iii) the number-average molecular weight (Mn) being 1,500 to 8,000; and (iv) the ratio of $Mw/Mn \geqq 3$.

2. A color toner according to claim 1, wherein the THF-soluble of the resin composition provides a rate (Mw/Mn) of 4.0 to 10.0.

3. The color toner according to claim 1, wherein the THF-soluble of the resin composition has an Mw of 10,000 to 40,000.

4. A color toner according to claim 1, wherein the THF-soluble of the resin composition has an Mn of 2,000 to 6,000.

5. A color toner according to claim 1, wherein the THF-soluble of the resin composition provides a rate (Mw/Mn) of 4.0 to 10.0, and has an Mw of 10,000 to 40,000, and an Mn of 2,000 and 6,000.

6. A color toner according to claim 1, wherein said paraffin wax is enclosed in the interior of the color toner particles.

7. A color toner according to claim 1, wherein the resin composition has a peak (Mp1) in the molecular weight range of 800 to 1,500.

8. A color toner according to claim 1, wherein the paraffin wax is contained in an amount of 9–25 wt. % based on the weight of the resin composition.

9. A color toner according to claim 1, wherein the paraffin wax has a melting point of 55° C. or higher.

10. A color toner according to claim 1, wherein the paraffin wax has a melting point of 65°–100° C.

11. A color toner according to claim 1, wherein the paraffin wax has a melting point of 70°–80° C.

12. A color toner according to claim 1, which has an agglomeration degree of 40 % or lower, and provides an agglomeration degree of 40 % or lower even after left standing at 50° C. for 48 hours.

13. A color toner according to claim 1, which has an agglomeration degree of 1–30 %, and provides an agglomeration degree of 1–30 % even after left standing at 50° C. for 48 hours.

14. A color toner according to claim 1, wherein the colorant comprises a dye or pigment and is contained in an amount of 0.5 to 40 wt. part per 100 wt. parts of the resin composition.

15. A color toner according to claim 1, wherein the colorant comprises a dye or pigment and is contained in an amount of 1 to 25 wt. parts per 100 wt. parts of the resin composition.

16. A color toner according to claim 15, wherein the colorant comprises a compound selected from the group consisting of phthalocyanine pigment, quinacridone pigment, and xanthene dye.

17. A color toner according to claim 14, wherein the colorant comprises carbon black.

18. A color toner according to claim 16, wherein the resin component comprises a vinyl polymer and a paraffin wax.

19. A color toner according to claim 14, wherein the resin composition comprises a vinyl polymer or copolymer and a paraffin wax.

20. A color toner according to claim 1, wherein the resin component comprises a styrenic polymer or styrenic copolymer, and a paraffin wax.

21. A color toner according to claim 1, which comprises non-magnetic toner particles.

22. A color toner according to claim 1, wherein the resin composition comprises a styrenic polymer or copolymer produceable by suspension polymerization.

23. A color toner according to claim 1, produced by the suspension polymerizable of the polymerizable monomer in combination with a polar polymer or copolymer.

24. A color toner according to claim 23, wherein said polar polymer or copolymer comprises a cationic polymer of copolymer.

25. A color toner according to claim 23, wherein said polar polymer or copolymer comprises an anionic polymer or copolymer.

26. A color toner according to claim 1, in the form of particles, each said particle having a pseudo-capsule structure comprising a surface layer rich in a polar polymer or copolymer.

27. A color toner according to claim 1, in the form of particles, each said particle having a pseudo-capsule structure comprising a surface layer rich in a polar polymer or copolymer and a core part rich in said paraffin wax.

* * * * *

UNITED STATES PATENT AND TRADEMARK OFFICE

CERTIFICATE OF CORRECTION

PATENT NO. : 5,130,219

DATED : July 14, 1992

INVENTOR(S) : HIROMI MORI, ET AL.

It is certified that error appears in the above-identified patent and that said Letters Patent is hereby corrected as shown below:

COLUMN 2

Line 25, "sufficient be" should read --sufficiently--.

COLUMN 3

Line 23, "rate" should read --ratio--.
Line 41, "rate" should read --ratio--.

COLUMN 6

Line 48, "U.S.A.." should read --U.S.A.--.

COLUMN 7

Line 42, "$W_1$ The" should read --$W_1$. The--.

COLUMN 8

Line 4, "en" should read --an--.
Line 24, "heat-resistant" should read --heat resistance--.

COLUMN 10

Line 42, "1,1'-azobis(cyclohexane-dimethylvaleronitrile;" should read --1,1'-azobis(cyclohexane-2-carbonitrile, 2,2'-azobis-4-methoxy-2,4-dimethylvaleronitrile;--.

UNITED STATES PATENT AND TRADEMARK OFFICE

CERTIFICATE OF CORRECTION

PATENT NO. : 5,130,219

DATED : July 14, 1992

INVENTOR(S) : HIROMI MORI, ET AL.

It is certified that error appears in the above-identified patent and that said Letters Patent is hereby corrected as shown below:

COLUMN 12

Line 12, "left" should be deleted.
Line 17, "left" should be deleted.
Line 18, "agglomerate" should be deleted.
Line 33, "the" should be deleted.
Line 53, "tone" should read --toner--.

COLUMN 15

Line 10, "left" should be deleted.

COLUMN 17

Line 14, "fixing wherein" should read --fixing condition providing a non-offset temperature region wherein--.
Line 17, "image." should read --images.--.
Example 5, "Junyaku," should read --Junyaku)--.

COLUMN 18

Line 53, "Example 5," should read --Examples 5,--.

COLUMN 19

Line 54, "Examples 9 to and" should read --Examples 9 to 12 and--.
Line 58, "process" should read --color toners--.

COLUMN 21

Line 26, "temperature T1" should read --temperature $T_1$--.
Line 67, "rate" should read --ratio--.

UNITED STATES PATENT AND TRADEMARK OFFICE

CERTIFICATE OF CORRECTION

PATENT NO. : 5,130,219

DATED : July 14, 1992

INVENTOR(S) : HIROMI MORI, ET AL.

It is certified that error appears in the above-identified patent and that said Letters Patent is hereby corrected as shown below:

COLUMN 22

Line 1, "The" should read --A--.
Line 8, "rate" should read --ratio--.
Line 29, "left" should be deleted.
Line 32, "left" should be deleted.
Line 36, "part" should read --parts--.
Line 48, "claim 16," should read --claim 14,--.
Line 49, "component" should read --composition--.
Line 59, "claim 1," should read --claim 21,--.
Line 61, "produceable" should read --producible--.
Line 63, "polymerizable" (first occurrence) should read --polymerization--.

Signed and Sealed this

Ninth Day of November, 1993

Bruce Lehman

*Attest:*

BRUCE LEHMAN

*Attesting Officer*

*Commissioner of Patents and Trademarks*